US011664622B2

(12) United States Patent
Chen et al.

(10) Patent No.: US 11,664,622 B2
(45) Date of Patent: May 30, 2023

(54) ELECTRICAL CONNECTOR HAVING AN OUTER SHELL AND AN INSULATIVE HOUSING SIDE WALL TO DEFINE AN ENGAGING GROOVE AND A PAIR OF SIDE GROOVES

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: De-Jin Chen, Kunshan (CN); Lai-Hang Lv, Kunshan (CN); Xian-Wei Feng, Kunshan (CN); Yu-San Hsiao, New Taipei (TW); Shih-Wei Hsiao, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 21 days.

(21) Appl. No.: 17/377,138

(22) Filed: Jul. 15, 2021

(65) Prior Publication Data

US 2022/0021155 A1 Jan. 20, 2022

(30) Foreign Application Priority Data

Jul. 15, 2020 (CN) ..... 202010679600.0

(51) Int. Cl.
*H01R 13/627* (2006.01)
*H01R 13/436* (2006.01)
(Continued)

(52) U.S. Cl.
CPC ..... *H01R 13/6272* (2013.01); *H01R 13/436* (2013.01); *H01R 13/516* (2013.01); *H01R 13/629* (2013.01)

(58) Field of Classification Search
CPC ..... H01R 13/6581; H01R 13/6594; H01R 13/6595; H01R 13/6272; H01R 13/436; H01R 13/516; H01R 13/629
(Continued)

(56) References Cited

U.S. PATENT DOCUMENTS 10,601,181 B2 3/2020 Lu et al.
2017/0229817 A1 8/2017 Tsai et al.
(Continued)

FOREIGN PATENT DOCUMENTS

CN 201436704 U 4/2010
CN 201438518 U 4/2010
(Continued)

*Primary Examiner* — Gary F Paumen
(74) *Attorney, Agent, or Firm* — Ming Chieh Chang

(57) ABSTRACT

An electrical connector includes: an insulative housing having a mating slot; a contact module received in the insulative housing; and a metallic outer shell enclosing the insulative housing and having a latching portion spaced apart from a side wall of the insulative housing, wherein the metallic outer shell includes a pair of bulging portions flanking the latching portion to define, together with the side wall of the insulative housing, an engaging groove, and the metallic outer shell includes a pair of end walls and a pair of side portions between the end walls and the bulging portions, respectively, to define, together with the side wall of the insulative housing, a pair of side grooves.

5 Claims, 7 Drawing Sheets

(51) Int. Cl.
*H01R 13/516* (2006.01)
*H01R 13/629* (2006.01)

(58) Field of Classification Search
USPC ..... 439/607.45–607.4, 607.54
See application file for complete search history.

(56) References Cited

U.S. PATENT DOCUMENTS

| | | | | |
|---|---|---|---|---|
| 2018/0205177 | A1 | 7/2018 | Zhou et al. | |
| 2018/0212376 | A1* | 7/2018 | Wang | H01R 13/502 |
| 2019/0067860 | A1 | 2/2019 | Zhao | |
| 2020/0266584 | A1 | 8/2020 | Lu | |
| 2021/0218197 | A1* | 7/2021 | Lv | H01R 12/79 |
| 2021/0218201 | A1* | 7/2021 | Lv | H01R 13/6272 |
| 2021/0367381 | A1* | 11/2021 | Lv | H01R 13/629 |
| 2021/0399451 | A1* | 12/2021 | Lu | H01R 43/20 |
| 2021/0408732 | A1* | 12/2021 | Chen | H01R 13/6271 |

FOREIGN PATENT DOCUMENTS

| | | | |
|---|---|---|---|
| CN | 203690571 | U | 7/2014 |
| CN | 203707390 | U | 7/2014 |
| CN | 206524432 | U | 9/2017 |
| CN | 206820190 | U | 12/2017 |
| CN | 208045830 | U | 11/2018 |
| CN | 210245775 | U | 4/2020 |

* cited by examiner

ELECTRICAL CONNECTOR HAVING AN OUTER SHELL AND AN INSULATIVE HOUSING SIDE WALL TO DEFINE AN ENGAGING GROOVE AND A PAIR OF SIDE GROOVES

BACKGROUND OF THE INVENTION

1. Field of the Invention

The present invention relates to an electrical connector including an insulative housing, a contact module received in the insulative housing, and a metallic outer shell enclosing the insulative housing and having a latching portion spaced apart from a side wall of the insulative housing, wherein as a design improvement the metallic outer shell cooperates with the insulative housing to define plural grooves for engaging a mating connector.

2. Description of Related Arts

China Patent No. 210245775 discloses an electrical connector having an engaging groove that is defined by an insulative housing and a metallic outer shell thereof as well as a pair of side grooves that are defined by a pair of blocks of the insulative housing and a pair of corner portions of the metallic outer shell.

SUMMARY OF THE INVENTION

An electrical connector comprises an insulative housing having a mating slot, a contact module received in the insulative housing, and a metallic outer shell enclosing the insulative housing and having a latching portion spaced apart from a side wall of the insulative housing, wherein the metallic outer shell includes a pair of bulging portions flanking the latching portion to define, together with the side wall of the insulative housing, an engaging groove, and the metallic outer shell includes a pair of end walls and a pair of side portions between the end walls and the bulging portions, respectively, to define, together with the side wall of the insulative housing, a pair of side grooves.

DETAILED DESCRIPTION OF THE PREFERRED EMBODIMENTS

Figure 1:
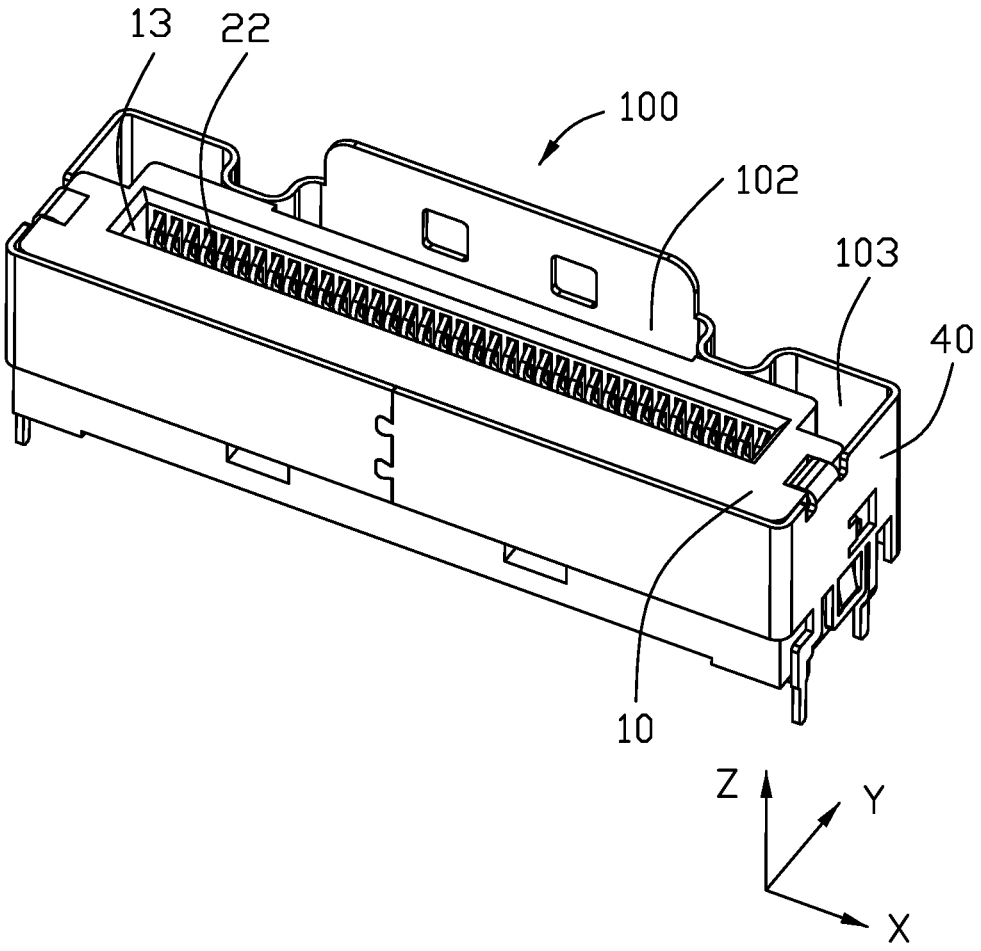
FIG. 1 is a perspective view of an electrical connector in accordance with the present invention.
Figure 2:
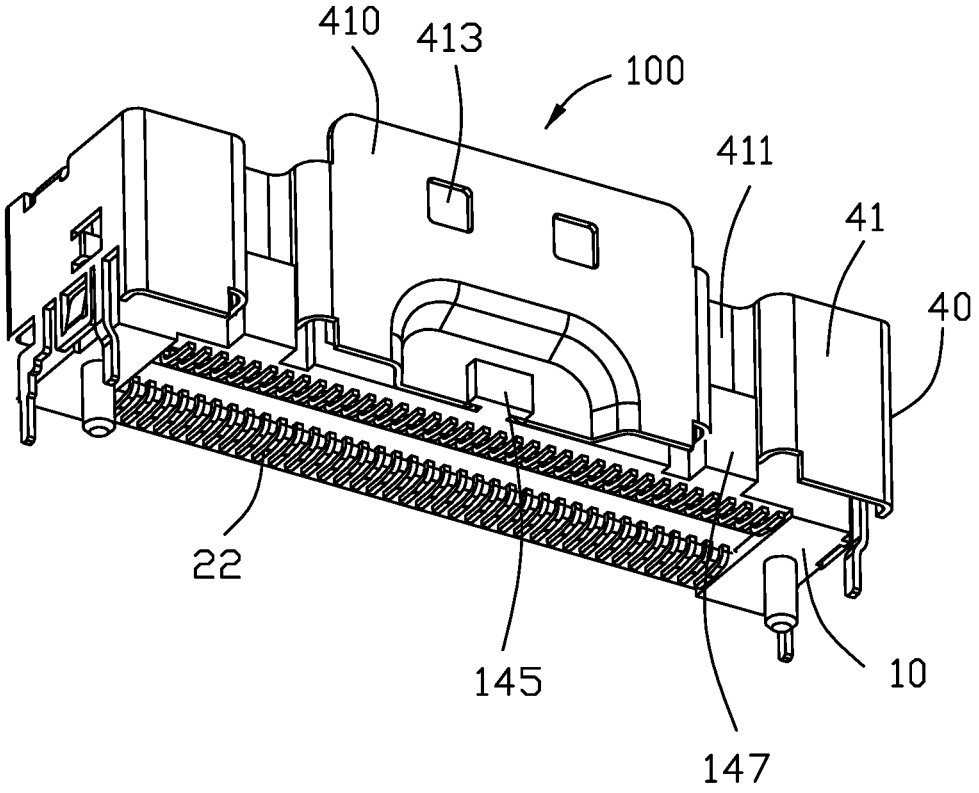
FIG. 2 is another perspective view of the electrical connector.

Referring to FIGS. 1-7, an electrical connector 100 of a vertical type has a mating direction along Z axis. The electrical connector 100 may be a right-angle type as well so as to have a horizontal mating direction.

The electrical connector 100 includes an insulative housing 10 elongated along X axis, a contact module 20 (a left one and a right one in the embodiment shown) received in the insulative housing 10, and a metallic outer shell 40 enclosing the insulative housing 10.

The insulative housing 10 has a mating face 11 and a mounting face 12, a mating slot 13 through the mating face 11, a first and a second side walls 14 and 15, two end walls 16, and a mounting groove 18 through the mounting face 12. Contact-receiving grooves 17 are formed on the first and second side walls 14 and 15.

The contact module 20 has an insulator 21 and a plurality of contacts 22. The insulator 21 has a protrusion 211, a slot 212, and one or more blocks 213. Each of the first and second side walls 14 and 15 has corresponding holes 141. Each contact 22 has a contacting portion 221, a mounting portion 223, and a connecting portion 222.

The metallic outer shell 40 has a board 41, a side wall 42, and a pair of end walls 43, together defining a receiving space 401. The board 41 is spaced a distance from the first side wall 14 of the insulative housing 10 and has a pair of holes 413. The board 41 has a latching portion 410 containing the pair of holes 413 which are substantially leveled with a top edge of the side and end walls 42 and 43. The board 41 further has a pair of bulging portions 411 flanking a middle portion 412 or the latching portion 410 to define, together with the first side wall 14 of the insulative housing 10, an engaging groove 102. The metallic outer shell 40 also includes a pair of side portions 416 between the end walls 43 and the bulging portions 411, respectively, to define, together with the first side wall 14 of the insulative housing 10, a pair of side grooves 103.

The side wall 14 has a depression 142 facing the middle portion 412 of the metallic outer shell 40. There are a pair of notches 146 at respective junctions of the side wall 14 and the end walls 16. The notches 146 are exposed to the pair of side grooves 103, respectively.

Figure 3:
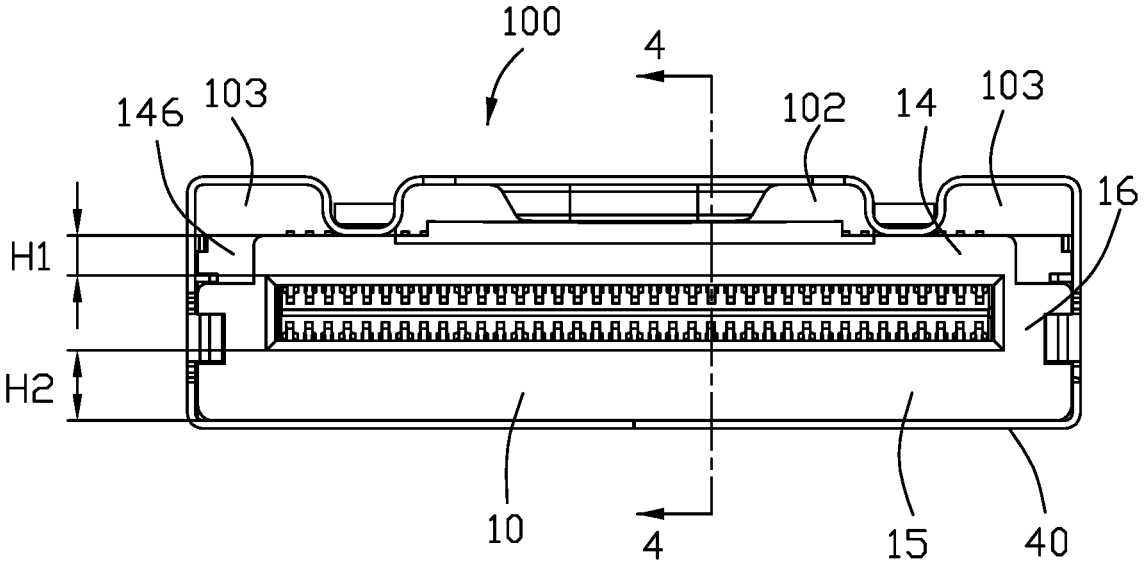
FIG. 3 is a top plan view of the electrical connector.
Figure 4:
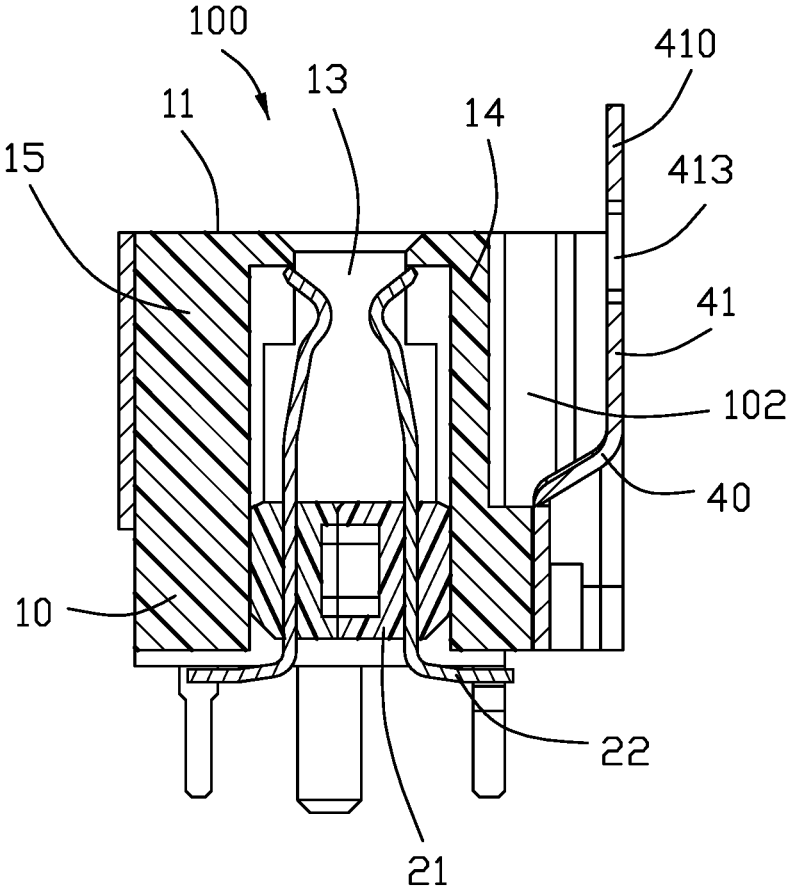
FIG. 4 is a cross-sectional view of the electrical connector taken along line A-A in FIG. 3.
Figure 5:
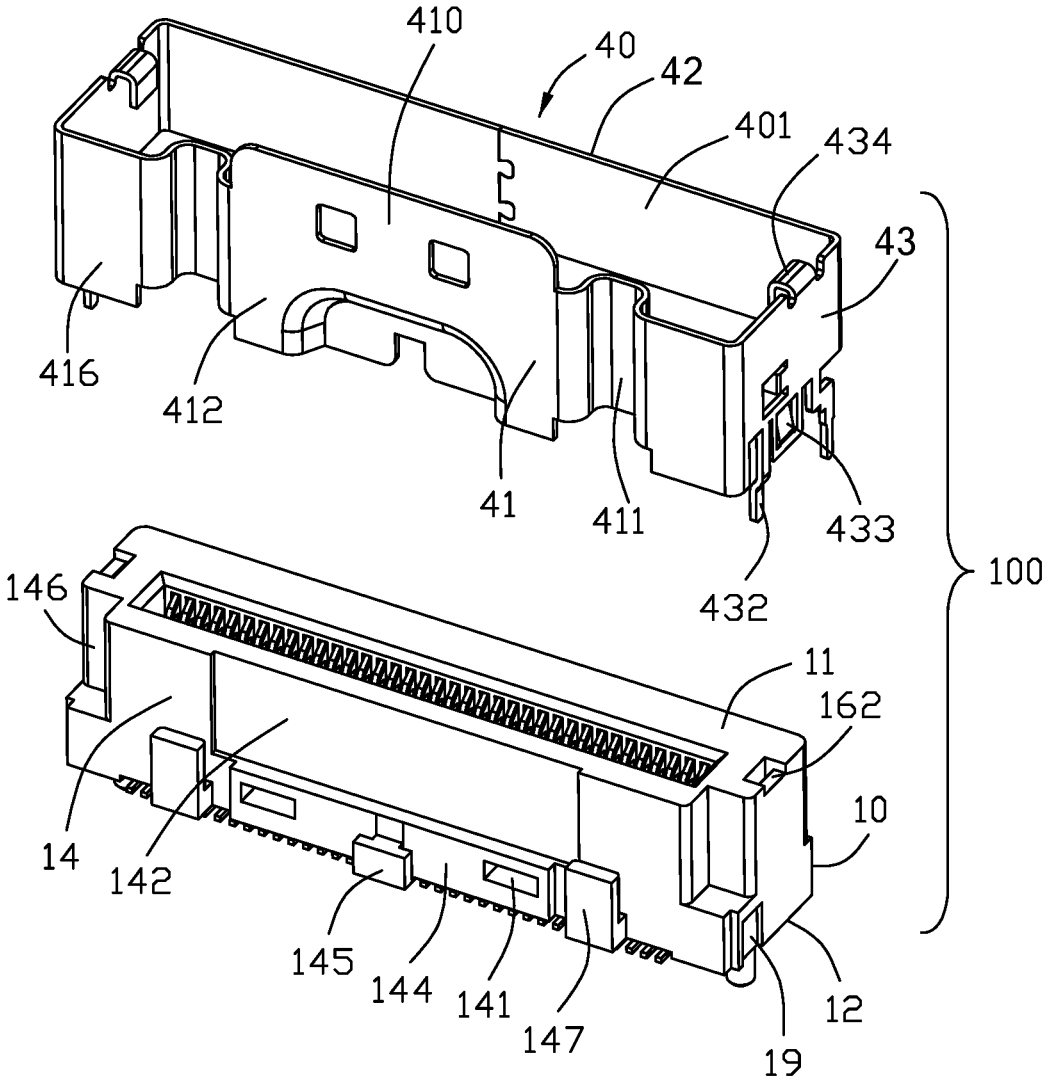
FIG. 5 is an exploded view of the electrical connector in FIG. 1.
Figure 6:
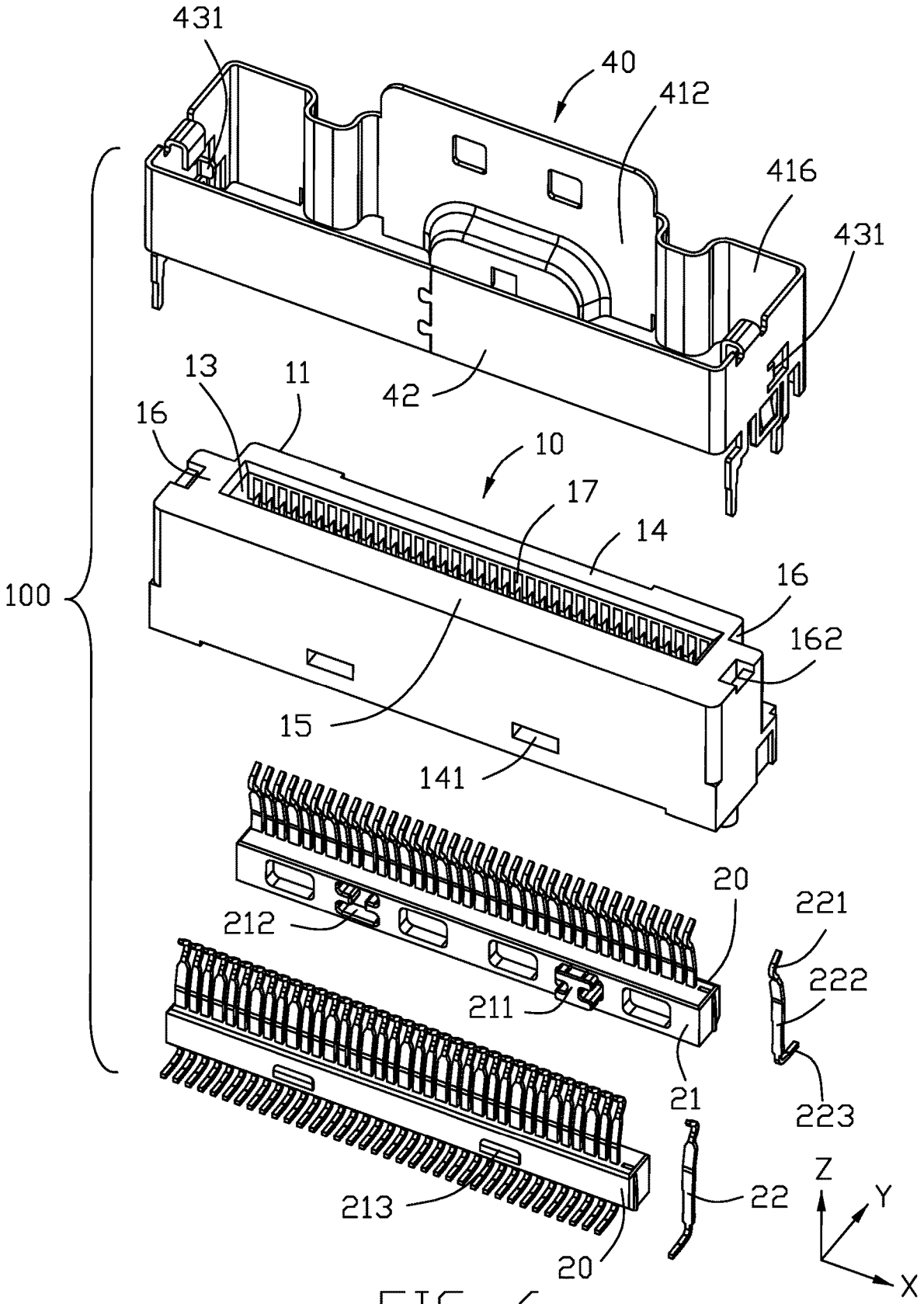
FIG. 6 is a further exploded view of the electrical connector in FIG. 5.
Figure 7:
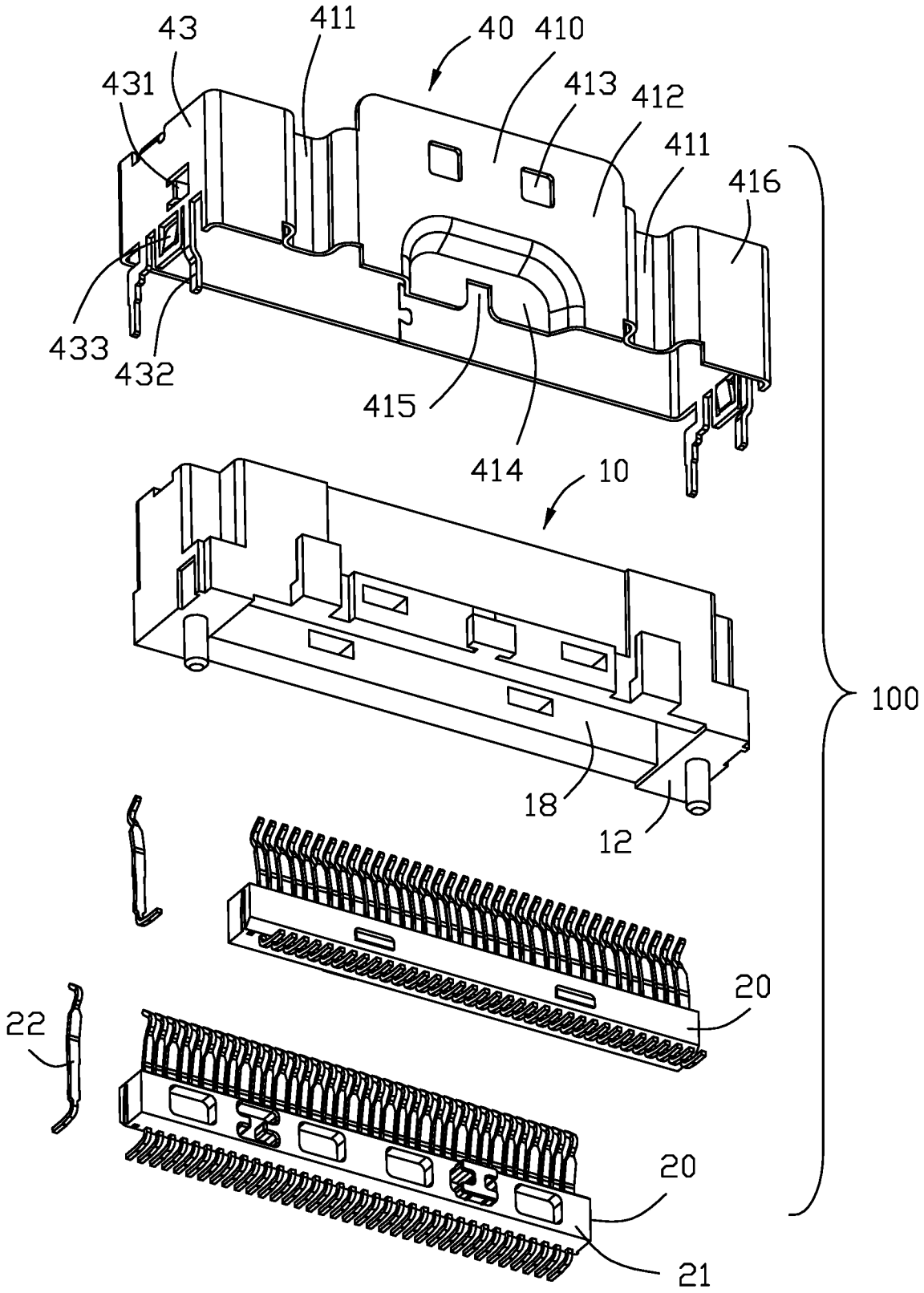
FIG. 7 is a view similar to FIG. 6 but from another perspective.

Referring specifically to FIG. 3, the bulging portion 411 is substantially U-shaped and abuts against the side wall 14 of the insulative housing 10. The bulging portion 411 separates the engaging groove 102 from the side groove 103.

The first side wall 14 has a thickness H1, along Y axis, which is less than a thickness H2 of the second side wall 15. At a bottom of the first side wall 14 there is a step 144. A combined thickness of the step 144 and the first side wall 14 is substantially equal to the thickness of the second side wall 15. The insulative housing 10 has a first lug 145 securing the latching portion 410 and a pair of second lugs 147 securing the pair of bulging portions 411. The board 41 of the metallic outer shell 40 includes an extension 414 which has a slot 415 for engaging the lug 145.

The notches 146 of the insulative housing 10 receive a pair of claws 431 provided on the end walls 43. Each end wall 43 also has a pair of legs 432 and a clip 433 for catching in a respective recess 19 of the housing 10.

The present invention redesigns the metallic outer shell 40 to together with the first side wall 14 provide the engaging groove 102 and the pair of side grooves 103 for properly positioning a complementary mating connector.

What is claimed is:

1. An electrical connector comprising:

an insulative housing having a mating slot;

a contact module received in the insulative housing; and a metallic outer shell enclosing the insulative housing and having a latching portion spaced apart from a side wall of the insulative housing; wherein the metallic outer shell includes a pair of bulging portions flanking the latching portion to define, together with the side wall of the insulative housing, an engaging groove; and the metallic outer shell includes a pair of end walls and a pair of side portions between the end walls and the bulging portions, respectively, to define, together with the side wall of the insulative housing, a pair of side grooves.

2. The electrical connector as claimed in claim 1, wherein the insulative housing has a pair of notches exposed to the pair of side grooves, respectively.

3. The electrical connector as claimed in claim 1, wherein the insulative housing has a first lug securing the latching portion and a pair of second lugs securing the pair of bulging portions.

4. The electrical connector as claimed in claim 1, wherein the bulging portion is substantially U-shaped and abuts against the side wall of the insulative housing.

5. The electrical connector as claimed in claim 1, wherein the insulative housing has an opposite side wall, and a thickness of said side wall is less than a thickness of the opposite side wall.

* * * * *